United States Patent [19]

Kambic

[11] 4,429,556

[45] Feb. 7, 1984

[54] LOCK MECHANISM

[75] Inventor: Raymond V. Kambic, Joliet, Ill.

[73] Assignee: Brink Locking Systems, Inc., Plainfield, Ill.

[21] Appl. No.: 292,397

[22] Filed: Aug. 13, 1981

[51] Int. Cl.[3] ..... E05B 55/06

[52] U.S. Cl. ..... 70/149; 70/150; 70/472; 70/218

[58] Field of Search ..... 70/149, 150, 151 R, 70/153, 218, 219, 220, 222, 223, 472

[56] References Cited

U.S. PATENT DOCUMENTS 3,999,411 12/1976 Kambic ..... 70/144

4,237,711 12/1980 Kambic ..... 70/150

*Primary Examiner*—Robert L. Wolfe

*Attorney, Agent, or Firm*—Trexler, Bushnell & Wolters, Ltd.

[57] ABSTRACT

There is disclosed a knob control arrangement or system whereby the status of a knob associated with a lock mechanism can be controlled from exteriorly of the lock housing and can be selectively rendered active-operable or passive-inoperable. In this regard, when in the passive-inoperable condition, the knob will merely rotate relative to the housing without imparting force or stress to the lock components. This mode of operation is achieved by providing a knob hub rotatably mounted to the lock housing to which a knob member may be affixed. Interiorly of the housing, the knob hub will move relative to a main cam member used to effect operation of the lock mechanism. The knob control arrangement includes means for selectively interconnecting and disconnecting the knob hub and the main cam member, such that when connected, an active-operable condition is attained, and when disconnected, the passive-inoperable mode is achieved.

33 Claims, 9 Drawing Figures

LOCK MECHANISM

BACKGROUND OF THE INVENTION

The present invention relates to a lock mechanism for mounting to a door or a door frame wherein the door will control access to a secured area. More particularly, the present invention relates to a lock mechanism having incorporated therein a knob control arrangement which permits a knob member for the lock mechanism to be rendered active or passive, at the selection of an operation from exteriorly of the lock mechanism, such that when in the passive condition, the knob member or members can rotate freely without imparting motion or placing strain upon the internal components of the lock mechanism, and when in the active condition, rotation or movement of the knob members will effect operation of the lock mechanism.

There are many instances wherein it is desirable to be able to control selectively access to a secured area by means of the lock mechanism used on the door leading to said area. And to this end, to effect this control exteriorly of the lock mechanism by selectively rendering the knob or operating member operable or inoperable with respect to the internal components of the lock. The basic components of most lock mechanisms do not vary to a great extent, in that these mechanisms normally include some form of latch member, an external operating member, such as a knob, that is coupled for relative movement with respect to the lock mechanism, and various internal cams and link members for converting movement of the operating member into operation of the latch member. The normally accepted procedure in effecting this control involves utilization of some form of latch or blocking means internally of the lock mechanism which is engageable with one or more of the internal cams or link members to prevent or block movement thereof. An example of this type of control means can be found in the inventor's prior U.S. Pat. No. 4,237,711 issued Dec. 9, 1980 and entitled "LOCK MECHANISMS." In the embodiment illustrated therein, solenoid operated latches are used selectively to block the operation of a cam member or roll back to which the external knob member is affixed.

While the above specifically discussed prior art arrangement has proven satisfactory for numerous uses, it is subject to certain disadvantages. More specifically, with this and other types of knob control arrangements wherein operability of the knob is controlled from the exterior of the housing, the knob is always in an active state. That is to say, the external knob or operating member is operably connected with the internal latch mechanism at all times, such that rotation of the knob will result in operation of the latch mechanism. To render the knob inoperable, operation of the knob is merely blocked by some form of internal latch mechanism. As such, one trying to operate the lock can place considerable force on the knob, and correspondingly, upon the internal mechanism of the lock, especially the components of the internal latch mechanism. The force placed thereon could become extensive enough to overcome the blocking operation through damage or failure of the internal latch and lock mechanism.

With the present invention, a knob-control system or arrangement is provided such that when it is desired to render the knob mechanism inoperative, this is achieved by producing a passive condition for the knob. That is to say, when the inoperative-passive condition is achieved, the knob is not operatively connected to the internal components of the lock mechanism, and as such is free to rotate without placing any force or strain on said internal components. The active-operable condition for the knob is achieved by selective coupling of the knob to the internal mechanism such that knob movement will affect operation of the internal mechanism to retract the latch bolt as desired. As such, with the present invention it is possible to control the operation of the lock mechanism from a remote location or exteriorly of the lock, such that when it is in the passive-inoperative condition, any attempt at operating the lock via the knob or knobs will not result in the placement of stress or strain on the internal lock components. As such, the lock cannot be forced by placing stress upon the internal mechanism to overcome the blocking arrangement.

As will be discussed more fully with regard to the detailed description of the disclosed embodiment which follows, there is shown two specific embodiments of the present invention. In the first embodiment, the overall knob control arrangement utilizes a solenoid for effecting operation of the control means for rendering the knob passive or active, as desired. In the second illustrated embodiment a novel linkage arrangement is employed in conjunction with the basic knob control system. Which linkage arrangement as illustrated is key actuated via the cam member of a lock set carried by the lock housing. As a further matter, with regard to the utilization of a solenoid to affect actuation of the knob control arrangement, the system can be made "fail-safe" or "fail-secure" as desired. More specifically in this regard, the solenoid employed could be of the type such that upon disruption of power, whether intentionally or due to a power failure, the knob will automatically be placed in the active or operable condition, thus achieving a "fail-safe" condition. On the other hand, the solenoid arrangement may be such that upon a disruption of power, the passive-inoperative condition is achieved so that attempts to operate the knob will not result in operation, thereby rendering the unit "fail-secure."

DESCRIPTION OF THE ILLUSTRATED EMBODIMENTS

Figure 1:
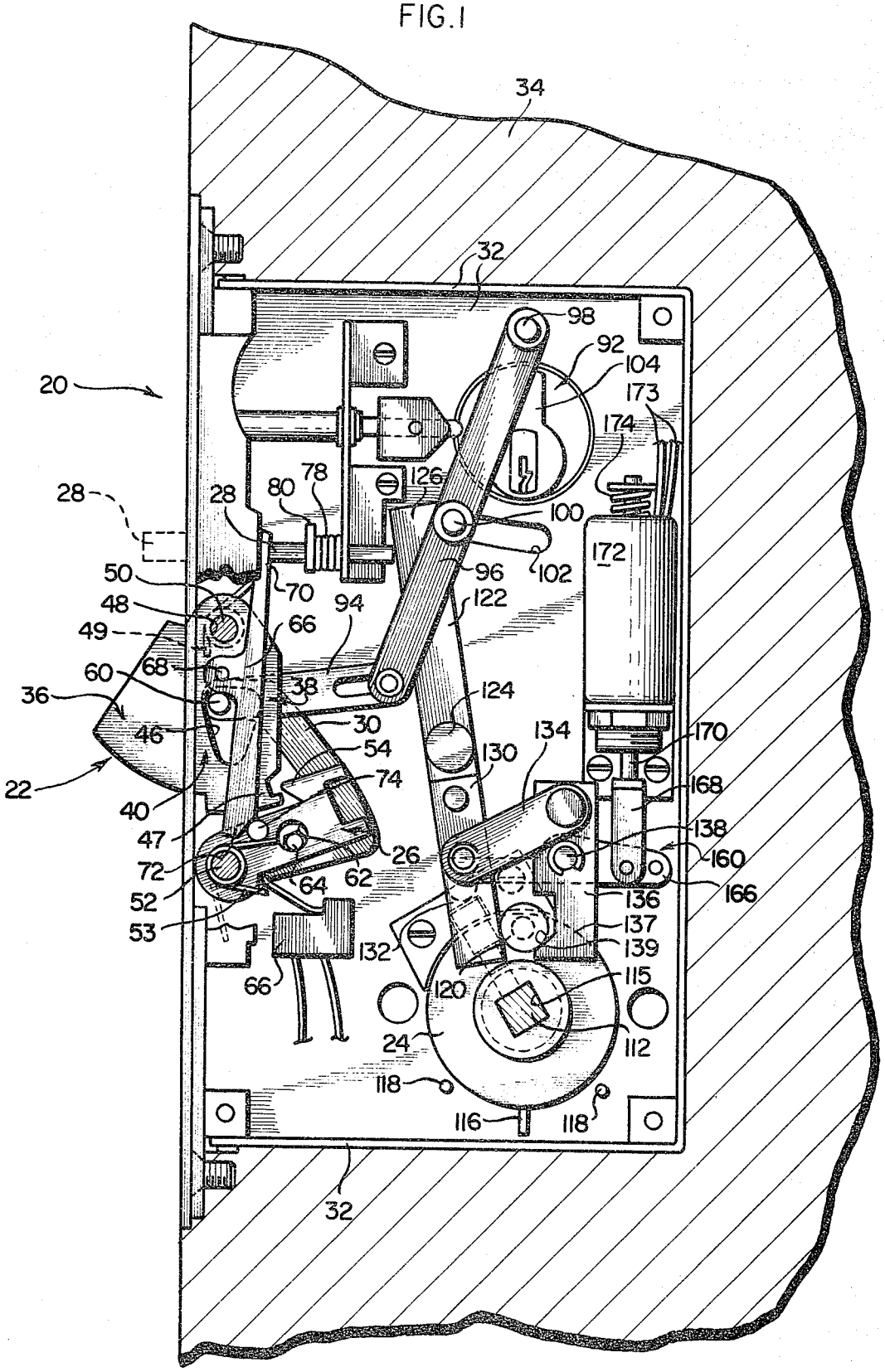
FIG. 1 is a sectional view of a lock mechanism employing the knob control arrangement of the present invention.

Referring now to the drawings, and initially to FIGS. 1–6, one form of lock mechanism 20 utilizing the knob control system of the present invention is illustrated. With regard to the lock mechanism 20 as shown in FIG. 1, the specific construction of the latch bolt 22, the main cam member or rollback 24 and the various internal levers and linkages used to obtain operation of the latch bolt 22 are not critical to the present invention. That is to say, the invention as defined and claimed hereinafter may be used with lock mechanisms of varying designs, the specific design as shown in the drawings having been selected for purposes of illustration.

While the basic operation and construction of the lock mechanism 20 as shown in FIG. 1 will be discussed hereinafter, the overall construction and operation of this design is discussed in greater detail in the inventor's prior U.S. Pat. No. 4,237,711, identified above, which disclosure is incorporated herein by reference. This prior patent and its disclosure will be most helpful should any questions arise as to the structure or operation of the latch bolt 22, the deadlock member 26, the deadlock trigger 28 or the innerconnection of these members with respect to the main operating lever 30 which is in the form of a bell crank.

Figure 2:
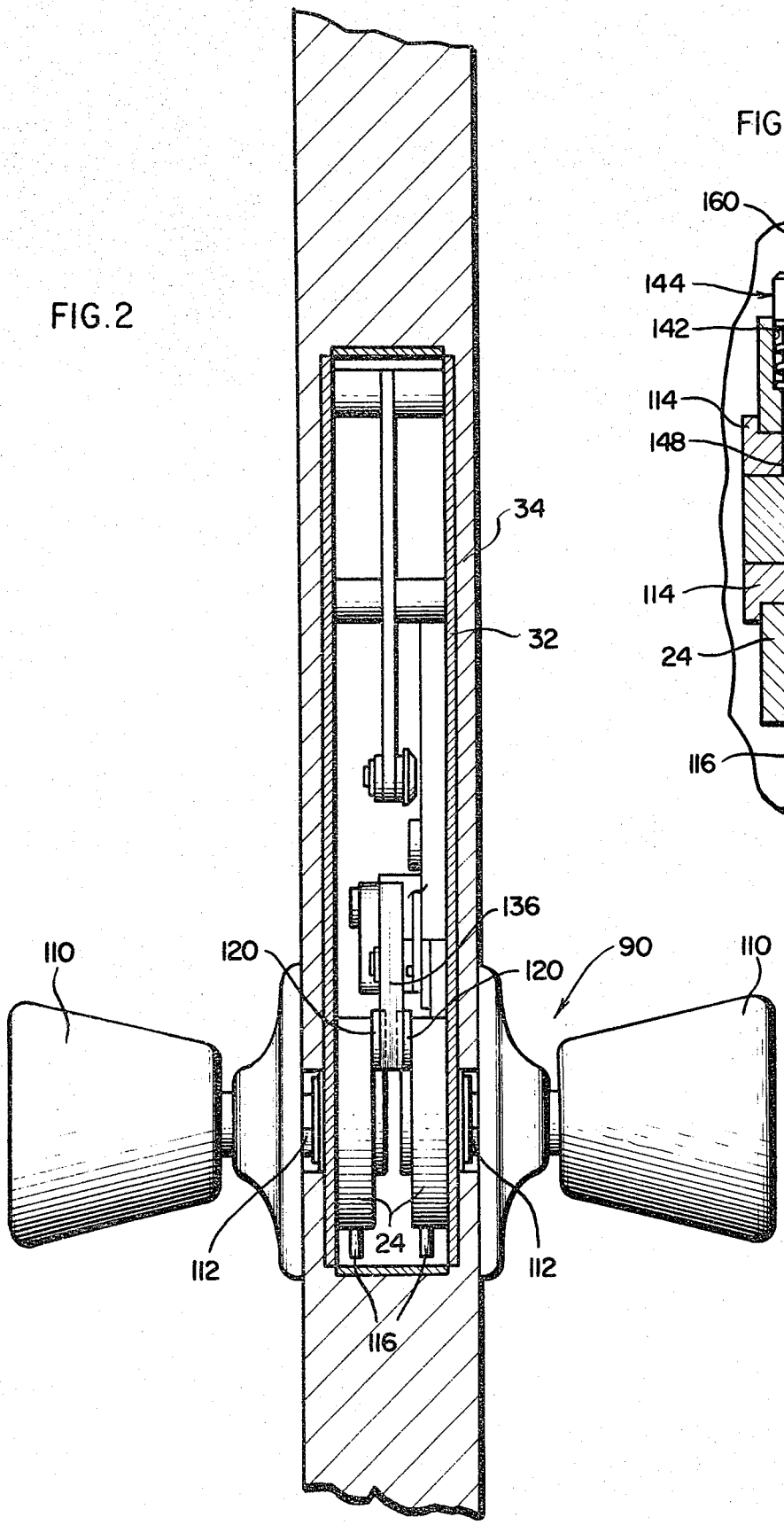
FIG. 2 is a partial sectional view taken at right angles to the view of FIG. 1, and illustrates a pair of standard knobs in operative association with the lock mechanism.

The construction and operation of the lock mechanism 20 will now be considered with regard to FIGS. 1 and 2. Basically, lock mechanism 20 includes a casing structure 32 which in the illustrated embodiment is fabricated from a series of separate components and is adapted for mortise mounting in a door. The latch bolt 22 includes an end or exterior portion 36 which extends from the edge of the door 34 for reception in a strike aperture formed in a strike plate (not shown) carried by the door frame, which engagement maintains the door in a closed and latched position. The exterior portion 36 of the latch bolt 22 may include one or more tapered surfaces, on the side opposite that illustrated which will cause the bolt to be cammed to its retracted position upon engagement with the strike plate during closing movement of the door. The surface of the end portion 36 visible in FIG. 1 is flat. The interior portion 38 of the latch bolt 22 is of a generally bifurcated construction to provide a pair of wall sections 40, only one of which is visible in FIG. 1. Each wall section 40 includes a triangular shaped aperture 46 and an end segment 47, the purpose for which will become apparent for a discussion which follows. In addition, the latch bolt 22 includes an aperture 48 through which a pivot pin 50 is disposed to effect pivotal mounting of the latch bolt with respect to the housing 32. A coiled spring 49 is disposed about the pivot pin 50 and urges the latch bolt 22 to the extended position as illustrated in FIG. 1.

Mounted adjacent the latch bolt 22 is a deadlock lever 26. This lever is pivotally mounted by a pivot pin 52 to the casing 32 and includes a hook-shaped free end portion 54 which when said lever is in the blocking position as illustrated, will overlie the end 47 of the latch bolt 22 to prevent retraction thereof. The deadlock lever 26 is urged to the blocking position by a spring 53 carried by the pivot pin 52. The deadlock lever 26 is also of a bifurcated design and as such the main lever or bell crane member 30 is disposed intermediate thereof, and is also pivotally mounted to by the pivot pin 52.

The main lever 30 is connected to both the latch bolt 22 and the deadlock lever 26 by separate lost motion connections. With regard to the latch bolt 22, the main lever 30 carries a pin 60 disposed in the triangular shaped slots or apertures 46 mentioned previously. As to the deadlock lever 26, said lever 26 includes an oversized aperture 62 in which a much smaller pin 64 carried by the main lever 30 is disposed. The purposes for these lost motion connections will become clear from the description of the operation of the lock mechanism as illustrated. Also shown in FIG. 1 is a switch arrangement 66 which can be used to monitor the position of the deadlock lever 26.

The lock mechanism 20 as shown in FIG. 1 also includes a deadlock trigger mechanism for controlling the position of the deadlock lever 26. In this regard, it will be appreciated that when the door is in the open position, it is desirable to have the deadlock lever 26 moved out of blocking relationship so that when the door is closed, the tapered surfaces (not shown) on the latch bolt 22 will engage the strike plate (not shown) to cam the latch bolt inwardly. It can be appreciated that if the deadlock member 26 were in the blocking position, this operation could not occur. The structure which permits this mode of operation includes the spring biased deadlock trigger mechanism 28, which will now be discussed in greater detail.

It should be noted that the condition of the lock mechanism 20 as illustrated in FIG. 1, is that as would occur when the door 34 is in the closed latched position, with the latch bolt 22 engaged in the strike aperture. In this condition, the deadlock trigger mechanism 28 will permit the deadlock lever 26 to move to the blocking position under the urging of the spring 53, as shown. It should be noted that intermediate the deadlock trigger mechanism 28 and the deadlock lever 26, there is provided a deadlock cam lever 66 which is pivotally mounted with respect to the lock mechanism about a pivot point 68. The deadlock cam lever 66 includes a first end 70 associated with the deadlock trigger mechanism 28 and a second end 72 associated with the camming surface engaged against a pin 74 carried by the deadlock lever 26. Accordingly, when the deadlock trigger member 28 is depressed, as is shown in FIG. 1, the deadlock lever 26 will assume the blocking position as shown in FIG. 1 under the biasing action of the spring 53 which causes the pin 74 to bias the cam lever 66 to the illustrated position.

When the door is in the open condition the spring means 78 of the deadlock trigger mechanism 28 will tend to bias the trigger to the dotted extended position. When this occurs, the trigger will move relative to the end 70 of the cam lever 66 and an abutment 80 thereon will engage the end 70 to cause the cam lever 66 to pivot in a counter-clockwise direction. This pivotal movement causes the second end 72 to engage the pin 74 on the deadlock lever 26 forcing said deadlock lever in a clockwise direction, out of blocking relationship with respect to the latch bolt 22. Thus, when the door is in the open condition, the latch bolt 22 is not blocked, and is free to move under the action of the cam surfaces thereon, as discussed previously.

When the door assumes the closed position, the deadlock trigger 28 will be depressed by the strike plate surfaces, thereby freeing the deadlock lever to move to the blocking position. This will not occur immediately as the latch bolt will remain depressed until it aligns itself with the strike aperture. Once the latch bolt 22 is aligned with the strike aperture, the force provided by the spring 49 will cause the latch bolt 22 to be extended and disposed within said aperture. The extension of the latch bolt will then free the deadlock lever 26 to operate under the urging of the spring 53 to assume the blocking position as shown in FIG. 1.

The mechanism for operation of the latch bolt 22 when the door is in the closed position will now be discussed, and it should be noted that this mechanism differs somewhat from that as disclosed in the above-mentioned prior U.S. patent. In this regard, the illustrated embodiment envisions the use of a knob set 90, FIG. 2, for affecting such operations, as well as the key set 92, FIG. 1, both of which are designed to produce pivotal movement of the main lever or bell crank 30 to operate the latch bolt 22. Looking to FIG. 1, it should be noted that the main lever 30 has affixed thereto a link 94 which link 94 is in turn connected by a pin-and-slot connection to a primary operating link 96. The primary operating link 96 is pivotally mounted to casing 32 at point 98 and includes a roller cam 100 having an end thereof disposed in a guide slot 102 in the casing. It should be noted, that one portion of the casing 32 has been removed, and that a cover would overly the structure as shown, the cover having corresponding slots and apertures for reception of the various pivot pins, etc.

If the primary operating link 96 is pivoted about point 98 in a counterclockwise direction, that is to the right of the position as shown, the main lever 30 will be moved in a clockwise direction, tending to retract the latch bolt 22. The key set and knob set mechanisms 90 and 92 for alternately effecting movement of the primary operating link 96 will now be discussed before discussing the overall operation of the lock mechanism.

With regard to the key set 92 there is provided a cam member 104, which when a key is inserted and turned, will be rotated and brought into engagement with the roller cam 100. The engagement with the roller cam 100, assuming counterclockwise rotation of the cam 104 will produce the above discussed corresponding counterclockwise movement of the primary operating link 96 and the attendent retraction of the latch bolt.

The knob set 90, is best viewed in FIG. 2, and includes a pair of knob members 110 mounted on opposite sides of the door 34. Each knob member, as is conventional, includes a polygonal shaped shaft 112, which extends through the casing 32 for engagement with the internal lock components. In this regard, the operation of the knob set 90 will be discussed with respect to one said knobs 110 it being appreciated that the other knob will operate essentially in the same manner. Further, the knob control arrangement, discussed hereinafter can be associated with one or the other of the knobs 110 or a separate knob control arrangement could be provided for each knob, as desired.

Returning to FIG. 1, for each knob 110, there is provided a knob hub 114 which is rotatably mounted with respect to the casing 32. The manner of effecting this mounting can be seen in FIG. 6. Disposed about the knob hub 114 and rotatably carried thereon, is the main cam member 24, often referred to as a "roll back" with the knob hub 114 and the main cam member 24 being capable of operable interconnection for joint movement. As will be discussed in greater detail hereinafter, the present invention envisions a knob control arrangement for selectively controlling this interconnection.

The main cam member 24, further includes a stop pin 116, while the housing 32 includes a pair of abutment pins 118 which cooperate with the stop pin 116 to define the limits of rotation of said cam member 24. On the inwardly facing surfaces of the cam member or roll back 24, there is provided an eccentrically mounted abutment 120. An elongate operating link 122 is pivotally mounted to the casing 32 at a pivot point 124, and includes an end 126 which is disposed for engagement with the roller cam 100. The other end of said elongate link 122 is connected to an off-set link member 130 which in turn has one of its ends 132 positioned for engagement with the abutment 120. Affixed to the off-set link 130 is a secondary link mechanism comprised of a cross link 134 and a camming link 136, the latter being pivotally mounted at pivot point 138. The camming link 136 includes a notched end 137 providing a cam surface 139 engaging the abument 120 oppositely of the end 132 of off-set link 130.

With the above discussed structure in mind, and assuming that the knob hub 114 and the main cam 24 are coupled or interconnected for movement, the operation of the lock mechanism as above described will now be detailed. Initially, upon rotation of one of the knob members 110, rotative movement will be imparted to the knob hub 114, due to the disposition of the polygonal shaft 112 in the polygonal aperture 115 formed in the knob hub. Rotation of the knob hub 114 in the clockwise direction as viewed, will cause the abutment 120 to engage the cam surface 139 on the link 136, causing said link 136 to pivot about its pivot point 138.

Through the bridge link 134, this movement is imparted to the elongate link 122 causing said link to move in a clockwise direction with the remote end 126 thereof engaging the roller cam 100 to produce counterclockwise movement of the primary operating link 96, which, as will be discussed hereinafter, will produce withdrawl of the latch bolt 22. Should the knob 110 and knob hub 114 be rotated in a counterclockwise direction, as viewed in FIG. 1, the abutment 120 will engage the end 132 of the offset link 130, again causing link 122 to pivot in a clockwise direction to produce counterclockwise movement of the primary operating link 96 via the roller cam 100, also effecting withdrawl of the latch bolt 22.

Upon counterclockwise movement of the primary operating link 96, the link 94 connected to the main lever or bell crank 30 will be pulled to the right as viewed. This movement will cause the main lever or the bell crank 30 to pivot about its pivot point 52 in a clockwise direction. The initial pivoting movement of the bell crank will, through the lost motion connection provided by pin 64 disposed in the oversized aperture 62 of the deadlock 26, effect rotative, retractive movement of the deadlock lever 26 relative to the latch bolt 22. In this regard, it will be noted that the lost motion connection provided by pin 64 and the oversized aperture 62 envisions a degree of lost movement which is considerably less than that provided with regard to the latch 22 by the lost motion connection of pin 60 in the triangular aperture 46. Thus, upon rotation of the main lever or bell crank 32, the deadlock lever 26 will be moved out of blocking position, before the main lever 32 has brought the pin 60 into engagement with the right hand portion of the slot 46 as viewed, which engagement, when it occurs, will cause the latch bolt 22 to pivot upwardly or in a counterclockwise direction about its pivot point 50, to retract the latch bolt 22 with respect to the casing 32.

Thus, the latch bolt 22 can be operated by either the key set 92 or the knob set 90, with the initial rotative movement of either unit serving to first retract the dead lock bolt lever 26 out of blocking relationship with respect to the latch bolt 22, with continued movement then effecting the retractive movement of the latch bolt 22 as desired.

The above discussion has been directed to the primary operation of the lock mechanism 20 and is believed helpful to an overall understanding of the disclosure. As was noted above, the detailed construction and operation of the lock mechanism 20 is illustrated and discussed to a greater extent in the inventor's prior U.S. Pat. No. 4,237,711. Discussion now is directed to the knob control arrangement which is illustrated primarily in FIG. 1 and FIGS. 3–6.

The knob control arrangement of the present invention is designated generally 140 in FIGS. 3–6 and will now be discussed primarily with respect to said figures, and also with regard to FIG. 1. Looking first to FIG. 3, it should be noted that the main cam member 24 includes a radially disposed through bore 142 in which there is positioned a pin member 144. A spring 146 is provided which operates against the enlarged head portion 147 of the pin member to urge the pin member radially outward of the bore 142.

Figure 6:
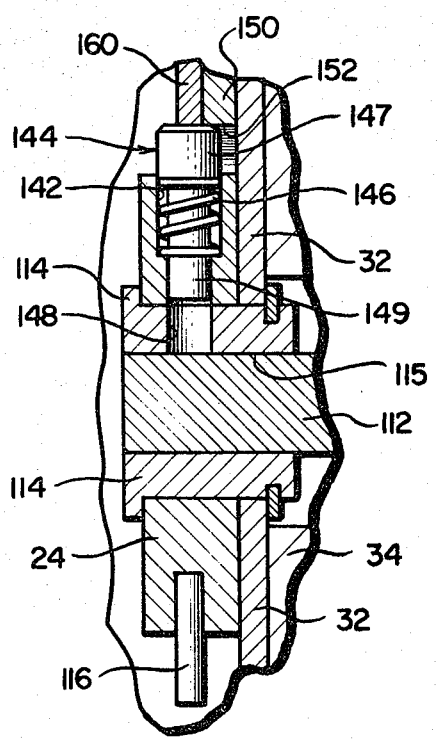
FIG. 6 is a sectional view taken along the line 6—6 of FIG. 3 in the direction indicated.
Figure 3:
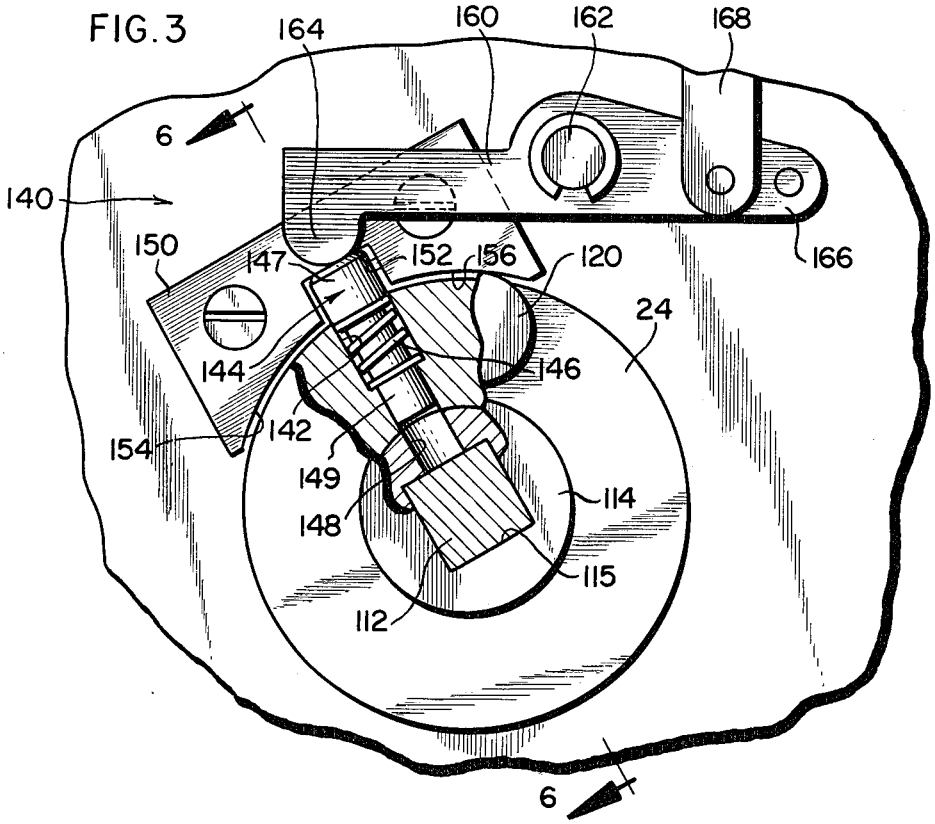
FIG. 3 is an enlarged detailed view, partially in section, illustrating the portion of the mechanism utilized for attaining coupling of the knob hub with the cam member.
Figure 4:
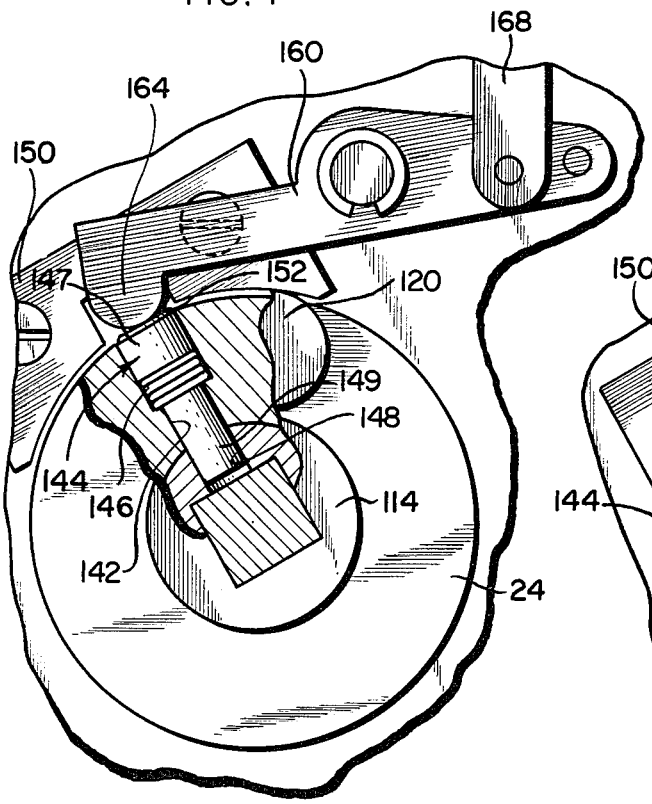
FIGS. 4 and 5 are views similar to FIG. 3, illustrating various conditions for the mechanism of FIG. 3 upon operation of the overall knob control arrangement.
Figure 5:
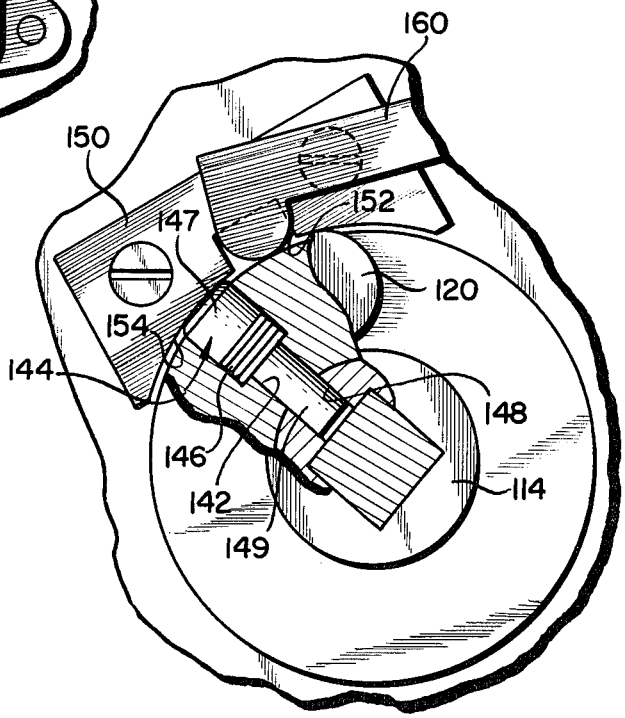

The knob hub 114 upon which the cam member 24 is mounted, see FIG. 6, includes a radial bore 148, which is sized to receive the end 149 of the pin 144 opposite the enlarged head 147, as is shown in FIGS. 4 and 5. It can be appreciated, keeping in mind the fact that the main cam member 24 is rotatably mounted on the knob hub 114, that when the pin 144 is engaged in bore 148, the knob hub 114 and the cam member 24 are coupled or interconnected for joint rotative movement. When the pin 144 is in the position as shown in FIG. 3, however, with the spring 146 urging said pin 144 radially outwardly, the knob hub 114 and the cam member 24 are not interconnected for joint rotative movement, with knob hub 114 free to rotate relative to said cam member 24.

The components of the knob control arrangement 140 for achieving selective interconnection of the knob hub 114 and cam member 24 will now be considered in some detail. In this regard, disposed proximate the peripheral surface of the cam member 24 is a guide plate 150. The guide plate 150 includes a notch 152 and guide surfaces 154 and 156 on opposite sides of said notch 152. As can be seen in FIG. 6, the guide plate 150 only partially overlies the pin 144, with the degree of overlap being sufficient to retain the pin 144 in the bore 142 against the urging of the spring 146.

A knob lock actuator lever 160 is provided proximate the camming member 24, said lever 160 being pivotally mounted to the casing 32 by pivot pin 162. The knob lock actuator lever 160 includes a first end having an abutment 164 disposed to engage the top surface of the enlarged head 147 of pin 144. The end portion 164 of lever 160 is disposed adjacent to guide plate 150 and will engage that portion of head 147 of the pin 144 that does not underlie said guide plate 150, as shown in FIG. 6. The opposite end 166 of the knob lock actuator lever 160 is affixed to a moveable link 168, which link 168 when actuated will produce a rocking or rotative movement for the knob lock actuator lever 160. It can be appreciated, as shown in FIG. 4, that if the knob lock actuator lever 160 is pivoted in a counterclockwise direction, the abutment end 164 will engage the spring biased pin 144 and will drive the pin 144 radially inwardly to dispose the remote end 149 thereof in the knob hub aperture 148, thereby interconnecting the knob hub 114 and the main cam member 24 for joint rotative movement.

With reference now to FIG. 5, the function of the guide plate 150 will now be discussed. In this regard, it can be appreciated that as the knob hub 144 and cam member 24 rotate, engagement of the pin 144 in the knob hub aperture 148 much be maintained. In this regard, the knob lock actuator lever 160 will attain initial depression of the pin 144. As the knob hub 114 and cam member 24 are rotated, the enlarged head 147 of the pin 144 will be brough under one or the other of the guide surfaces 154 or 156 (depending upon the direction of rotation), with said guide surfaces serving to maintain the pin 144 in a depressed condition to retain the coupled engagement of the knob hub 114 and cam member 24. Thus, it is only when the pin member 144 is aligned with the slot 152 in the guide plate 150, that the pin cam move radially outward to disrupt the coupled engagement or otherwise disconnect the cam member 24 and the knob hub 114.

Directing attention now to FIG. 1, the actuator mechanism for the knob control system or arrangement will now be considered. In this regard, the moveable link 168 affixed to the end 166 of the knob lock actuator lever 160 is attached to the operating arm 170 of a solenoid device 172. The solenoid 172, as is standard practice, includes leads 173 extending exteriorly of the casing 32 to permit the solenoid to be operative from a location remote from the lock mechanism 20. The solenoid 172 is of the type which includes a spring member 174 tending to bias the operating arm 170 in a first direction, with a magnetic core and coil arrangement (not shown) disposed internally thereof for moving the operating arm 170 in a second, opposite direction. As was discussed in the introductory portion of the specification, the solenoid 172 may be of one of two types, dependent upon whether the knob lock arrangement is to "fail secure" or "fail safe." In the illustrated embodiment, a "fail safe" arrangement is illustrated, that is, if power to the solenoid is disrupted, either through power failure or by controlled operation, the spring 174 will cause the knob lock actuator arm 160 to pivot to the FIG. 4 position thereby tending to bias the pin 144 inwardly to engage to interconnect the cam 24 and the knob hub 114. If a "fail secure" arrangement were employed, the spring 174 would be disposed such that upon disruption of power, the knob lock actuator lever 160 would be biased in an opposite direction, that is, to the FIG. 3 position with the pin disposed out of engagement with the knob hub 114, and the knob hub and the cam 24 no longer interconnected.

Accordingly, assuming the "fail safe" arrangement illustrated in FIG. 1 operation of the device will now be discussed. Accordingly, when power is not supplied to the solenoid 172, the spring 174 will tend to move the lever 168 upwardly causing the knob lock actuator lever 160 to pivot from the FIG. 3 condition to that of FIG. 4. This movement of the lever 160 will force the pin 144 radially inward to couple the knob hub 114 to the main cam member 24. As such, operation of the knob 110, in either direction, will cause the knob hub 114 and correspondingly the cam member 24 to rotate, thereby producing operation of the lock mechanism to retract latch bolt 22 as was discussed in greater detail above. When it is desired, for security reasons or otherwise, to render a praticular knob 110 associated with the arrangement passive or inoperative, the solenoid 172 is energized. When this occurs, the operating arm 170, and correspondingly the linear moveable link 168 are urged downwardly, causing the knob lock actuator lever 160 to pivot to the position as shown in FIG. 3. When this occurs, the spring bias pin 144 will move outwardly into the notch 152, serving to disconnect the knob hub 114 from the main cam member 24. As such, any attempt to operate the lock mechanism 20 by rotation of the knob 110 associated with the particular knob hub 114, will merely produce relative movement of the knob hub with respect to the camming member 24, without imparting rotation to the cam member 24 sufficient to produce operation of the lock mechanism 20. It can be appreciated, that due to the passive nature of the condition of the mechanism at this point, no stress or force will be placed upon the various linkages and mechanism of the lock. With prior art design wherein the operation of the main cam 24 is merely blocked by some internal blocking mechanisms, excessive force may overcome the blocking function and it would be possible to achieve unauthorized operation of the lock mechanism 20.

There are several features which should be noted at this point in the discussion. First, the various spring members 49 and 53 discussed above, place a biasing action not only on the components with which they are immediately associated, but also serve to bias the various links and lever members, such that when the knob set 90 is released, the lock mechanism 20 is designed such that the internal spring mechanism will cause the various components, and most particularly the cam member 24, to assume the position as illustrated in FIG. 1. That is, to say when no force is applied to the main cam member 24, it will automatically assume the FIG. 1, position wherein the pin 144 is aligned with the notch 152. Accordingly, when an operator selects the passive-inoperative mode, the internal spring mechanism will urge the cam member 24 to the FIG. 3 position automatically, with the notch 152 not only serving to receive the pin 144, but restraining the cam member 24 against unauthorized rotation until such time as the operator selects the active-operative mode.

The other aspect which should be noted, is the situation wherein the knob hub 114 is in a rotative disposition wherein the knob hub aperture 148 does not align with the pin 144, and the active-operative mode is selected. When this occurs, either through the spring action of the solenoid, or the operation of the magnetic coil, a force will be placed on the link 168 tending to move the link 168 and the knob lock actuator lever 160. If movement is prevented, due to the misalignment of pin 144 and aperture 148 the force thereon will be maintained. At such time as the knob hub 114 is rotated to a position wherein aperture 148 aligns with the pin 144, the pin will be biased inwardly into engagement with the knob hub aperture 148 and the active-operable condition for the knob will be attained.

Thus, it is believed clearly, that the present invention, insofar as discussed at this point, discloses a means whereby a knob may be rendered passive-inoperable, or active-operable at the selection of an operator. Most importantly, when in the passive-inoperable condition, any attempt to operate the lock will merely result in rotation of the knob in the knob hub, without imparting any force, stress or movement to the internal mechanism of the lock 20. Further, when it is subsequently desired to render the knob active-operable, this condition or mode can be achieved quite readily by operation of the knob actuator mechanism.

Figure 8:
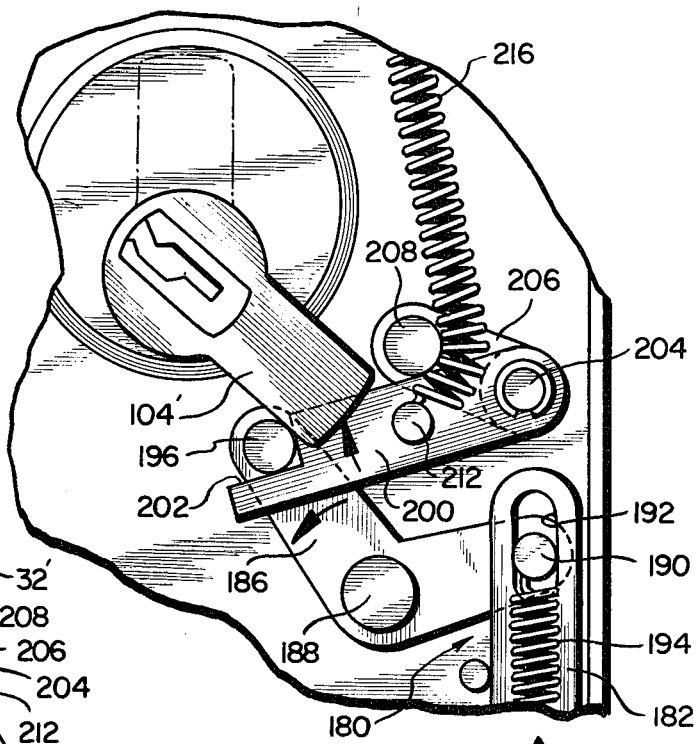
FIG. 8 is an enlarged, partial view of the mechanism of FIG. 7, illustrating operation of a catch member and a lost motion mechanism that is utilized in conjunction with the key set operated linkages of FIG. 7.
Figure 7:
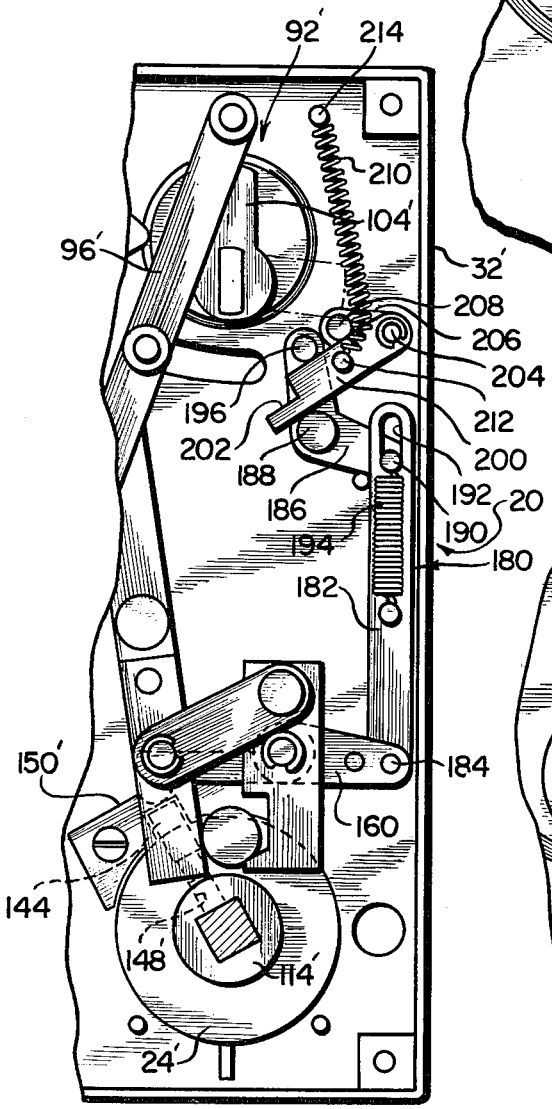
FIG. 7 is a partial plan view of an alternate embodiment of the present invention wherein a key set and novel linkage arrangement is employed for producing operation of the knob control mechanism.
Figure 9:
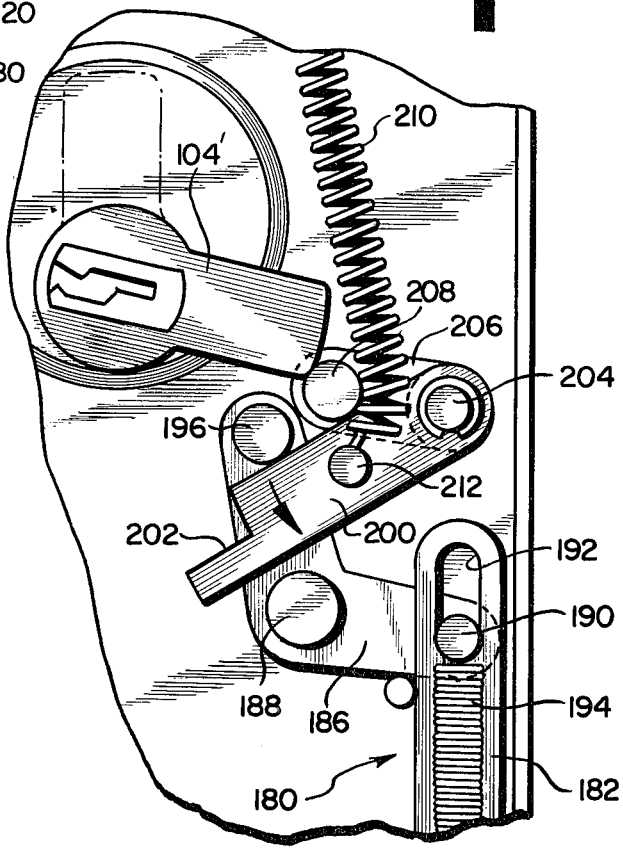
FIG. 9 is an enlarged, partial view similar to FIG. 8 illustrating the manner by which the catch member is released.

Turning now to FIGS. 7–9, there is illustrated an alternative form of the invention, wherein the knob control arrangement is operated by the key set. That is to say, the key set can be used to achieve operation both of the knob control arrangement as well as the basic operation of the lock mechanism 20', which is similar to that as discussed previously with regard to lock arrangement 20. It should be understood, however, that a separate key set may be employed for the knob control arrangement as desired. To attain operation via the key set, a novel and ingenious link mechanism is employed, which mechanism is designated generally 180 in FIG. 7, and replaces the solenoid mechanism as discussed above. The remainder of the lock mechanism 20' of FIG. 7 is essentially of the same construction as the lock mechanism 20 of FIG. 1 in as such, similar reference characters with a prime (') designation will be used to designate similar components.

Briefly, the main cam member 24' is rotatably carried on a knob hub 114' to which a knob member (not shown) is operatively coupled. A spring bias pin 144' is carried by the main cam member 24' with a knob lock actuator lever 160' and a guide plate 150' provided to affect the desired operation of the pin 144' into and out of engagement with the knob hub 114'. In the embodiment of FIG. 7, the knob lock actuator lever 160' is coupled to the key actuator control mechanism 180' which will control pivotal movement thereof as required to cause the pin 144' to move into and out of engagement with the knob hub 114'.

The key actuated knob control mechanism 180 of FIG. 7 includes an elongate pull link 182 which is moveable linearly and has one end affixed to the knob lock actuator lever 160' at location 184. A pivotally mounted bell crank type lever 186 is mounted to the casing 32' by a pivot pin 188 adjacent the upper end of pull link 182. One end of the bell crank lever 186 includes a pin 190 that is disposed in an elongate slot 192 formed in the end of the pull link 182 remote from its connection to the knob lock actuator lever 160'. In conjunction with the pin and slot connection 190–192, there is provided a spring member 194 having one end affixed to the pin 190 and the other to the pull link 182. The pin and slot connection 190–192, in conjunction with the spring 194 provides an interconnection between lever 186 and link 182 which is capable of permitting a lost motion type of operation, with energy being stored in the spring, as will be explained in greater detail hereinafter. The end of the bell crank 186, opposite that to which the pin 190 is mounted, includes a cam pin 196 engageable by the cam member 104' of the key set 90, upon rotation of the cam member from the position of FIG. 7 to that of FIG. 8, wherein said engagement is illustrated.

A catch mechanism is also provided for maintaining the bell crank lever 186 in the operated position of FIG. 8, as will also be explained hereinafter. The catch mechanism includes a catch lever 200 having a notched end 202, said lever 200 being pivotally mounted to the casing 32' by pivot pin 204. An operating link 206 is also pivotally mounted to the pivot pin 204, which link 206 is free to pivot relative to the catch lever 200. The link 206 has a pin 208 proximate the free end thereof, which pin is disposed for engagement with the catch link 200. Further, a second spring member 210 is provided, which spring member has one end affixed to the catch link 200 at 212, and the other end affixed to the casing 32' at location 214, the spring being engaged over the pin member 208 so as to provide a biasing force not only for the catch lever 200, but also for the link 206.

With regard to the operation of the novel key actuated link mechanism 180, attention is first directed to FIG. 7. In this regard, the condition as illustrated, the passive-inoperable condition, wherein the knob hub 114' and the cam member 24' are not interconnected. That is to say, the pin 144' is not engaged in the knob hub aperture 148'. Assuming that it is desired to render the knob (not shown) active-operable, to this end the key set 90' is operated to cause the cam 104' to rotate counterclockwise from the position as shown in full line in FIG. 7, to that as shown in dotted outline in said figure. The cam 104' will initially engage the pin 208, and will force the pin 208, lever 206 and the catch lever 200 downwardly in a counterclockwise direction, until the cam 104' passes pin 208. Immediately after passing pin 208, the cam 104' will engage pin 196 on the bell crank lever 186 causing said lever to rotate in a counterclockwise direction from the position as shown in FIG. 7, toward that of FIG. 8.

As the bell crank lever 186 rotates from the FIG. 7 position to the FIG. 8 position, the pin 190 will move relative to the slot 192 tending to stretch the spring 194 and place an upwardly directed force on pull link 182. Assuming that the pin member 144' is aligned with the knob hub aperture 148', the knob lock actuator lever 160' will be operated to force the pin 144' inwardly thereby interconnecting the knob hub 114' and the camming member 24' for joint rotation. As to what will occur when the pin 144' and the knob hub aperture 148' are not aligned, will be discussed hereinafter.

The bell crank lever 186 will continue its counterclockwise movement under the force of the cam 104' until the pin 190 engages the top of the slot 192, which engagement in effect operates as a stop or limit to the pivotal movement of the bell crank 186. At some time prior to reaching this limit of movement, the pin 196 will have reached a location aligned with the notched end 202 of the catch lever 200. As the catch lever 200 is urged upwardly by the biasing of the spring 210, once said alignment occurs, the lever 200 will move upwardly to cause the notched end 202 to engage the pin 196 as is shown in FIG. 8. In this condition, the catch lever 200 will maintain the bell crank lever 186 in the operated position as shown, such that the key set cam 104' can be returned to its original position and the key member (not shown) removed. It can be appreciated, that with the bell crank lever 186 maintained in the FIG. 8 position, a constant upward force is placed on the pull link 182, which maintains the knob lock actuated lever 160' in an operative position forcing the pin 144' radially inward into engagement with the knob hub 114' similar to that as shown in FIG. 4. The operation of the knob, the knob hub 114' and the cam member 24' will then be essentially as was illustrated and discussed with respect to FIGS. 3–6, with the guide plate 150' serving to maintain the engagement of the pin 144' with the knob hub 114' during rotated movement.

As noted above, when the pin 144' and the knob hub aperture 148' are aligned, the pull link 182 will move upwardly immediately to affect operation of the knob lock actuator link 160' as soon as the bell crank lever 186 is operated. The condition will now be considered, wherein the pin 144' and the knob hub aperture 148' are not aligned at the time that the key set 90' is used to operate the bell crank 186 to the position as shown in FIG. 8. In this regard, it will be noted that the lost motion connection provided by pin 190, slot 192 and the spring 194, enable the bell crank 186 to be operated even though the pull link 182 does not move. In this regard, bell crank lever 186 will move to its latched position of FIG. 8, with the pin 190 moving relative to slot 192 and stretching spring 194 effectively storing energy therein. The energy stored by spring 194 places a continued biasing force on the pull link 182, tending to move said link upwardly. In this regard, the knob lock actuator lever 160' cannot pivot, due to the misalignment of the pin 144' and aperture 148', correspondingly, the pull link 182 cannot move upwardly. Thus, once the above discussed operation action has occurred, should the knob subsequently be rotated and, the knob hub aperture 148' brought into alignment with the pin 144', the biasing force placed on the components by spring 194 will immediately cause the pin 144' to enter the aperture 148' thereby interconnecting the cam member 24' and the knob hub 114. The link mechanism 180 as described above, thus provides means whereby the lock mechanism 20' can be set in the active-operative mode, and this mode will be attained immediately if the pin 144' and the aperture 148 are aligned. If they are not aligned, however, the active-operative mode will be effected as soon as one tries to operate the knob, as rotation of the knob will produce rotation of the knob hub 114' thereby attaining alignment of the aperture 148' and pin 144' at some point in the rotative movement.

To release the knob control arrangement 180 of FIGS. 7–9 and permit the components to assume the passive-inoperative mode, FIG. 7, the key set 90' may be operated to produce rotation of the cam 104' in a clockwise direction. The cam 104' will initially engage the pin 208 on the lever 206, causing the pin 208 to be urged against the catch lever 200, with the catch lever 200 pivoting downwardly in a counterclockwise direction thereby freeing the notched end 202 from engagement with the pin 196 on the bell crank lever 186. When the above discussed downward, pivotal movement of the catch lever 200, and freeing of said lever from the pin 196 occurs, the condition as illustrated in FIG. 9 will be attained. In this regard, the spring 194 which tends to pivot the bell crank lever 186 clockwise, thereby permitting the components of the link arrangement 180 to assume the condition as illustrated in FIGS. 7 and 9. The pivoting of the bell crank lever 186 back to its original position removes the upward biasing force from the pull link 182, and correspondingly there is no force tending to pivot the knob lock actuator lever 160'. Accordingly, as soon as the spring biased pin 144' aligns with the notch in the guide plate 150', the pin 144' will move radially outward into said notch, thereby interrupting the previously effected interconnection between the knob hub 114' and the cam member 24'.

Once the above resetting operation has been completed, the key set cam 104' can be returned to its full line position of FIG. 7 and the key removed. The lock mechanism 20' now having the knob associated with knob hub 24' in a passive-inoperable condition.

There has been shown and described two embodiments of the knob control arrangement of the present invention in conjunction with one form of lock mechanism with which said invention may be employed. The specific elements and components illustrated and described constitute preferred forms of the invention, and as such it is not intended that the invention be limited to the specific details of the illustrated embodiment. In this regard, it is appreciated that those skilled in the art may devise modifications or variations of the illustrated structure, without departing from the spirit and scope of the invention as defined by the claims appended hereto.

The invention is claimed as follows:

1. A knob control arrangement for a lock assembly of the type including a housing and a lock mechanism, associated with said housing and including latch means, a cam member, and link means interconnecting the cam member and the latch means, said knob control arrangement including: a knob hub mounted with respect to the lock assembly housing for relative movement, and adapted to have a knob member operably engaged therewith, said knob hub being mounted juxtaposed said cam member interiorly of said housing, such that the knob hub can move relative to said cam member; means for selectively connecting and disconnecting said knob hub with respect to said cam member, such that when connected said knob hub and said cam member will be joined for joint movement, and a knob member engaged with the knob hub and said knob hub will be in an active condition whereby said operation thereof will produce movement of said cam member and correspondingly, the operation of said lock mechanism; however, when said knob hub and said cam member are not coupled for joint movement, a knob engaged with said knob hub and said knob hub will be in a passive condition, and can move relative to said cam member and said housing without producing operation of said locking mechanism.

2. A knob control arrangement according to claim 1 wherein said knob hub is rotatably mounted to said housing and said cam member is an annular member rotatably mounted on said knob hub.

3. A knob control arrangement according to claim 1 wherein said means for selectively coupling said knob hub to said cam member includes detent means for selective connecting and disconnecting said knob hub with said cam member, and actuator means for said detent means.

4. A knob control arrangement according to claim 1 wherein said means for selectively coupling said knob hub to said cam member for joint movement comprises: a spring-biased detect carried by said cam member and urged in a direction away from said knob hub; means on said knob hub adapted to have said spring-biased detent engaged therewith; an actuator means for selectively urging said detent into engagement with said knob hub against the bias of said spring, such that when said detent is engaged with said knob hub, said knob hub and cam member are connected for joint movement, said actuator means being operable to permit said detent to become disengaged from said knob hub to permit said knob hub to move relative to said cam member.

5. A knob control arrangement according to claim 4, wherein said actuator means comprises; an actuator mechanism capable of controlled operation from exteriorly of said lock mechanism housing; a pivotally mounted actuator lever having one end disposed for engagement with said spring biased detent and the other end coupled to said actuator mechanism, such that upon operation of said actuator mechanism, said actuator lever can be caused to assume either of a first position or a second position wherein when in one of said positions, said detent is urged into engagement with said knob hub to place said knob hub in an active condition, while when in the other of said positions, said spring biased detent will be disposed out of engagement with said knob hub thereby placing said knob hub in a passive condition.

6. A knob control arrangement according to claim 5 wherein said actuator mechanism comprises a solenoid having an operating arm thereof coupled to said actuator lever.

7. A knob control arrangement according to claim 6 wherein said solenoid is of the type including a spring biased operating arm and designed such that when energized the operating arm will assume a position moving said pivotally mounted actuator lever to a position whereby said detent will be urged into engagement with said knob hub, such that should power to said solenoid be disrupted, said operating arm will be automatically retracted, causing said actuating lever to assume a position whereby the spring biased detent is disengaged from said knob hub, said knob hub thereby automatically assuming a passive condition upon the disruption of power to said solenoid.

8. A knob control arrangement according to claim 6, wherein said solenoid is of the type that when energized, said operating arm will move said lever to a position permitting said spring biased detent to move out of engagement with said knob hub, however, should power be disrupted, said operating arm will be automatically biased to a position whereby it will move said operating lever to cause said spring-biased detent to be engaged with said knob-hub, thereby automatically causing said knob-hub to be placed in an active condition upon the failure or disruption of power to said solenoid.

9. A knob control arrangement according to claim 5, wherein said actuator mechanism comprises a key set including a cam member, and a series of link means and lever means for selectively urging said actuator lever to either of said first or said second positions.

10. A knob control arrangement according to claim 9, wherein said series of link and lever means comprises; a pull link coupled to said other end of said actuator lever; a pivotally mounted lever member; lost motion connection means coupling said lever member to said pull link, said lost motion connection means including spring means such that said lever member may be moved relative to said pull link from a first position to a second position to store energy in said spring means, which energy may be used to operate said pull link in conjunction with movement of said lever member, or subsequent to movement of said lever member from said first position to said second position.

11. A knob control arrangement according to claim 10 wherein said lost motion connection further includes a slot in said pull link with said lever member being engaged in said slot, and said spring means having one end affixed to said pull link and the other end affixed to said lever member.

12. A knob control arrangement according to claim 10, including catch means for maintaining said lever member in said second position, said catch means being selectively releasable by said key set to permit said lever member to return to said first position.

13. A knob control arrangement according to claim 12, wherein said catch means comprises, a pivotally mounted catch lever having means on a free end thereof for engagement with said link member; additional spring means urging said catch lever in a direction such that said catch lever will maintain said lever member in said second position; rotatably mounted operating link means engageable by said key set cam and positioned such that when rotated in a first direction by said key set cam said operating link means will move relative to said catch lever without effecting movement thereof, however, when rotated in a second, opposite direction, said operating link means will engage said catch lever to effect pivotal movement thereof out of engagement with said lever member, thereby permitting said lever member to assume its first position under urging of said first mentioned spring means.

14. A knob control arrangement according to claim 3 wherein said detent means comprises a pin member and said cam member includes a through bore in which said pin member is disposed, and a spring member disposed in said bore urging said pin member outwardly thereof away from said knob hub, such that one end of said pin member will extend from said cam member bore; guide plate means disposed adjacent said cam member, and including a notch therein for reception of said pin member when said pin member is urged to a position out of engagement with said knob hub, said guide plate further including guide surface means engageable with said pin member for maintaining said pin member in a second, knob hub engaging position, when said cam member is moved relative to said guide plate.

15. In combination, a lock assembly of the type comprising, a housing, a lock mechanism associated with said housing and including a latch bolt, a cam member, and link means innerconnecting the cam member and said latch bolt such that movement of said cam member will effect operation of said latch bolt; a knob control arrangement for selectively producing an active-operable condition for a knob member associated with said lock assembly, wherein rotative movement of said knob member will produce operation of said latch bolt and a passive-inoperable condition wherein an attempt to operate said knob member will merely cause said knob member to rotate relative to said lock assembly without producing operation of said latch bolt, or imparting stress to the components of said lock mechanism, said knob control arrangement including a knob hub rotatably mounted with respect to said housing and positioned juxtaposed to said cam member, said knob hub being adapted to have the knob member operably engaged therewith, and actuator means for selectively coupling and uncoupling said knob hub and said cam member, such that when said knob hub and said cam member are coupled for joint movement, said active-operable condition is attained and rotation of said knob hub will produce movement of said cam member and correspondingly operation of said latch bolt, and when uncoupled said passive-inoperable condition is attained and said knob and knob hub can rotate freely without producing operation of said latch bolt.

16. The combination according to claim 15, wherein said actuator means for said knob control arrangement further includes detent means selectively moveable between a first position wherein said detent means will couple said knob hub and said cam member for joint movement and a second position wherein said knob hub is free to rotate relative to said cam member without effecting movement thereof.

17. The combination according to claim 16 wherein said detent means is a pin member, and spring means urging said pin member to said second position, and said actuator means further includes means for moving said pin member against the force of said spring to said first position wherein said pin couples said knob hub and said cam member for joint movement.

18. The combination according to claim 17 wherein said actuator means includes, a pivotally mounted actuator lever, and an actuator mechanism, said actuator lever having one end disposed for engagement with said pin such that upon pivoting of said lever said pin member can be caused to assume said first or said second position, and said actuator mechanism being coupled with the other end of said lever to effect the desired pivotal movement thereof.

19. The combination according to claim 15, wherein said actuator means further includes a solenoid having an operating arm, and means interrconnecting said operating arm and said detent means, such that said solenoid can attain said selective movement of said detent means.

20. The combination according to claim 19, wherein said solenoid is of the type including a spring biased operating arm and designed such that when energized, the the operating arm will assume a position whereby said detent means will be urged into engagement with said knob hub, such that should power to said solenoid be disrupted, said operating arm will be automatically retracted, causing the detent means to be disengaged from said knob hub, said knob hub thereby automatically assuming the passive-inoperable condition upon the disruption of power to said solenoid.

21. The combination according to claim 19, wherein said solenoid is of the type that when energized, said operating arm will move to cause said detent means to move out of engagement with said knob hub, however, should power be disrupted, said operating arm will be automatically biased to a position whereby to cause said detent means to be engaged with said knob hub, thereby automatically causing said knob hub to be placed in an active-operable condition upon the failure or disruption of power to said solenoid.

22. The combination according to claim 16, wherein said actuator means includes, a key set including a cam member, and a series of link means and lever means operatively innerconnecting said key set and said detent means.

23. The combination according to claim 22, wherein said series of link and lever means comprises; an actuator lever for said detent means, a pull link coupled to said actuator lever; a pivotally mounted lever member positioned for engagement by said key set cam member, lost motion connection means coupling said pivotally mounted lever member to said pull link, said lost motion connection means including spring means such that said lever member may be moved relative to said pull link from a first position to a second position to store energy in said spring means, which energy may be used to operate said pull link in conjunction with movement of said lever member, or subsequent to movement of said lever member from said first position to said second position.

24. The combination according to claim 23 wherein said lost motion connection further includes a slot in said pull link with said lever member being engaged in said slot, and said spring means having one end affixed to said pull link and the other end affixed to said lever member.

25. The combination according to claim 23, including catch means for maintaining said lever member in said second position, said catch means being selectively releasable by said key set to permit said lever member to return to said first position.

26. In combination with a lock assembly including, a housing and a lock mechanism carried by said housing and comprised of a number of relatively moveable components including a latch member; an actuator arrangement associated with said lock mechanism for selectively operating one of said components of the lock mechanism, said actuator mechanism including, a pull link mounted for movement relative to said housing and having one end thereof operably coupled to said lock mechanism, such that movement thereof will produce a desired change in position of said lock mechanism component, a pivotally mounted lever member disposed proximate the other end of said pull link, lost motion connection means coupling said pivotally mounted lever member to said pull link, said lost motion connection means including spring means such that said pivotally mounted lever member may be moved relative to said pull link from a first position to a second position to store energy in said spring means, which energy may be used to operate said pull link in conjunction with movement of said lever member, or subsequent to movement of said lever member from said first position to said second position.

27. The combination according to claim 26, wherein said lost motion connection further includes a slot in said pull link, with said lever member having a pin engaged in said slot, and said spring means having one end affixed to said pull link and the other end affixed to said lever member.

28. The combination according to claim 23, including catch means from maintaining said lever member in said second position, said catch means being selectively releasable to permit said lever member to return to said first position.

29. The combination according to claim 26 wherein said actuator means further includes means for selectively effecting pivotal movement of said pivotally mounted lever member from exteriorly of said housing.

30. The combination according to claim 29 wherein said means for selectively effecting pivotal movement of said lever member comprises a key set mounted to said housing, said key set including a cam member engageable with said pivotally mounted lever member.

31. The combination according to claim 26 wherein said lock mechanism includes a cam member operably connected to said latch member, a knob hub rotatably carried by said housing and adapted to have a knob engaged therewith, and a knob control arrangement for selectively connecting said knob hub and said cam member for joint movement, and selectively disconnecting said knob hub and said cam member such that said knob hub and a knob engaged therewith can rotate relative to said housing without effecting operation of said cam member, said knob control arrangement including a moveable detent member for effecting said connection and disconnection between said knob hub and said cam member, said detent member being the component which position is changed by movement of said pull link.

32. The combination according to claim 31 wherein said detent member comprises a pin carried by said cam member, said pin being moveable into and out of engagement with said knob hub to effect said connection and disconnection.

33. The combination according to claim 32 wherein said pin is spring biased in a direction out of engagement with said knob hub, and said knob control arrangement further includes an actuator lever operable to bias said pin into engagement with said knob hub, said actuator lever being operatively coupled to said pull link such that movement of said pull link will result in the desired movement of said actuator lever to produce operation of said detent member.

* * * * *